US006805539B2

(12) United States Patent
Schubert

(10) Patent No.: US 6,805,539 B2
(45) Date of Patent: Oct. 19, 2004

(54) PLANT BUILDING FOR AN INSTALLATION AND METHOD FOR OPERATING A PLANT BUILDING

(75) Inventor: Falko Schubert, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 13 days.

(21) Appl. No.: 10/182,251

(22) PCT Filed: Jan. 15, 2001

(86) PCT No.: PCT/DE01/00139

§ 371 (c)(1),
(2), (4) Date: Jul. 26, 2002

(87) PCT Pub. No.: WO01/55560

PCT Pub. Date: Aug. 2, 2001

(65) Prior Publication Data

US 2002/0192086 A1 Dec. 19, 2002

(30) Foreign Application Priority Data

Jan. 27, 2000 (DE) ..... 100 03 517

(51) Int. Cl.[7] ..... F04B 23/00; E03B 11/00

(52) U.S. Cl. ..... 417/313; 137/574; 137/565.01

(58) Field of Search ..... 417/313, 423.14; 137/576, 561 A, 561 R, 565.01, 565.23, 565.37, 571, 574, 565.17; 415/200, 215.1, 88, 213.1, 182.1, 208.1

(56) References Cited

U.S. PATENT DOCUMENTS 3,502,220 A 3/1970 Kohlberg ..... 210/416
3,738,782 A * 6/1973 Fraser ..... 417/424
4,576,197 A * 3/1986 Kempers ..... 137/565.17
4,869,643 A * 9/1989 de Vries ..... 415/200
5,304,034 A * 4/1994 Bouwman ..... 415/214.1
6,561,754 B1 * 5/2003 Schwarz ..... 415/88

FOREIGN PATENT DOCUMENTS

DE PCT WO 00/01951 * 1/2000
GB 1385715 * 2/1975

OTHER PUBLICATIONS

P. Courcot, G. Goudy, J. F. Lapray; "Pumping Stations and Heavy Duty Raw Water Pumps"; 2048 GEC Alsthom Technical Review (1993) Oct., No. 12, Paris, FR, pp. 31–46.

Lueger "Lexikon der Technik" [Lexicon of technology] 4th edition; vol. 6; Lexikon der Energietechnik und Kraftmaschinen [Lexicon of power engineering and prime movers], A–K, edited by Rudolf von Miller, Deutsche Verlags–Anstalt GmbH, Stuttgart, 1965, pp. 666–667 and 669–670.

* cited by examiner

*Primary Examiner*—Charles G. Freay
(74) *Attorney, Agent, or Firm*—Harness, Dickey & Pierce, P.L.C.

(57) ABSTRACT

A plant building includes a purification chamber and a pump chamber with a pump for cooling water. The pump chamber directly adjoins the purification chamber and the geometry of the pump chamber is such that disturbing swirls are avoided while the installation is in operation, due to the high speed of the coolant. The direct proximity of the two chambers to each other results in lower cost due to the elimination of the usual steadying zones.

23 Claims, 3 Drawing Sheets

PLANT BUILDING FOR AN INSTALLATION AND METHOD FOR OPERATING A PLANT BUILDING

This application is the national phase under 35 U.S.C. §371 of PCT International Application No. PCT/DE01/00139 which has an International filing date of Jan. 15, 2001, which designated the United States of America and which claims priority on Patent Application No. DE 100 03 517.5 filed Jan. 27, 2000, the entire contents of which are hereby incorporated by reference.

FIELD OF THE INVENTION

The invention generally relates to an operations building for a plant, in particular for a power-generation plant, which has a pump chamber and a cleaning chamber for cooling water. The invention also generally relates to a method of operating the operations building.

BACKGROUND OF THE INVENTION

In an industrial plant, in particular in a power station for generating power, cooling water is necessary for operating the plant. A typical example for the use of cooling water is the cooling of steam in a cooling tower of a power station. In this case, the cooling water is generally removed from a natural reservoir, for example from a river or lake, and is first of all cleaned in the cleaning chamber in order then to be sent to plant components via the pump chamber, by a pump arranged therein. In large-scale plants, the delivery capacity of the pumping system is a number of cubic meters of cooling water per second. The flow paths, the cleaning arrangements for cleaning the cooling water, the pump chamber and, in particular, the pump are of correspondingly voluminous design. The behavior of the cooling liquid flowing into the pump is decisive for reliable and permanent disruption-free operation of the pump. In particular an as far as possible vortex-free flow into the pump is necessary for this purpose.

In terms of design, the cleaning chamber and the outlet cross section thereof are usually very narrow and high, whereas the pump chamber, which is arranged downstream of the cleaning chamber in terms of flow, is wide and flat and designed, for example, as a covered pump chamber. These extremely different chamber geometries and internals in the cleaning chamber, or downstream of the same as seen in the flow direction, cause turbulence in the cooling liquid. In order to prevent said turbulence or vortices resulting in the formation of surface or base vortices which are disruptive for the pump, a calming section is usually provided between the cleaning chamber and the pump chamber. The calming section requires a not inconsiderable amount of space, which adversely affects the costs during the production of the operations building.

The book by Lueger "Lexikon der Technik" [Lexicon of technology] 4th edition; volume 6; Lexikon der Energietechnik und Kraftmaschinen [Lexicon of power engineering and prime movers], A–K, edited by Rudolf von Miller, Deutsche Verlags-Anstalt GmbH, Stuttgart, 1965, pages 666–667 and pages 669–670, discloses an operations building for a power-generation plant. The operations building has a pump chamber for arranging a pump for cooling water and also a cleaning chamber. The operations building is designed as an intake structure on a free body of water with a number of intake chambers such that the water flows to the individual intake chambers uniformly and as far as possible in a vortex-free manner, and that the bottom of the body of water is not swirled up or adversely affected by the inflowing water.

The article entitled "Pumping stations and heavy duty raw water pumps for the cooling of industrial complexes and power plants" by Courcot, P., Goudy, G. and Lapray, J. F.; GEL Alstom Technical Review No. 12-1993; Paris; ISSN: 1148-2893, discloses a pump arrangement in which it is possible to dispense with an otherwise conventional calming section between the cleaning chamber and the pump chamber, a rotating screening arrangement nevertheless being provided exclusively. In the case of this prior art, in particular the formation of disruptive vortices in the cooling-water stream is not reliably avoided.

SUMMARY OF THE INVENTION

An object of an embodiment of the invention is to specify an operations building for a plant, and a method of operating an operations building, which ensure reliable plant operation with low plant-production costs.

The operations-building-related object may be achieved according to an embodiment of the invention by the operations building having a pump chamber for arranging a pump for cooling water and also a cleaning chamber, the pump chamber directly adjoining the cleaning chamber, it being the case that the pump chamber is connected to the cleaning chamber via an intake opening, which is adjoined by a wall region which runs obliquely in relation to the chamber side wall, and the flow cross section for the cooling liquid flowing into the pump chamber is tapered by means of a pump installed in the pump chamber, with the result that the cooling liquid, in order to avoid disruptive vortices, has a flow speed of approximately 2 to 3 m/s.

An embodiment of the invention takes as its departure point here, the surprising finding that the cleaning chamber may be arranged immediately in front of the pump chamber, that is to say that the conventional calming sections may be dispensed without disruptive vortices, in particular surface vortices, occurring in the pump chamber. This is because the vortices can be avoided by said expedient geometrical configuration of the pump chamber which results in a comparatively high flow speed. This relationship between the flow speed and vortice formation is surprising since, up until now, it has been assumed that success is only achieved in precisely the opposite way, that is to say the lowest possible speed should be set in order to avoid vortices. The level of a sufficient flow speed depends on a number of factors, in particular also on the quantity of cooling liquid which is to be pumped. In industrial plants with a pumping capacity of a number of cubic meters per second, a flow speed of approximately 0.5 m/s has been provided up until now in the calming section. In order to avoid the vortices, a higher flow speed than this, in particular of approximately between 2–3 m/s, is set.

One decisive advantage of this configuration is that the absence of the calming section results in the overall volume of the operations building being reduced and thus in the production costs for the operations building being reduced to a considerable extent.

The chamber geometry may be configured such that, during operation, the flow speed of the cooling liquid is increased as it passes into the pump chamber.

In conventional plants and in the plant described here, the flow speeds for the cooling water within a cleaning machine arranged in the cleaning chamber are approximately 1 m/s. Whereas, in conventional plants, this flow speed is reduced to approximately 0.5 m/s through the calming sections at the inflow to the pump chamber, the present embodiment, in contrast, provides an increase in the speed in order to form a sufficiently high flow speed.

An intake opening via which the cooling water flows into the pump chamber is adjoined by a wall region which runs obliquely in relation to the chamber side wall. This avoids backflow spaces in the pump chamber, which are a typical cause of the formation of vortices.

In a particularly preferred embodiment, the pump chamber is designed for such positioning of the pump that, by the displacing action of a pump tube, separation of the flow from the wall is reliably prevented despite the usually large expansion angle in the inflow region of the pump chamber.

With the pump installed, the flow cross section for the cooling liquid flowing into the pump chamber tapers. It is possible here for the diameter of the pump tube to vary over a large range, with the result that both pumps with a small tube diameter and high impeller speed and pumps with a large tube diameter and low impeller speed can be inserted into the same chamber. The tube diameter and the impeller speeds are selected here so as to achieve a low-level so-called "necessary net positive suction head" (NPSH) for avoiding the so-called cavitation, that is to say the formation and the abrupt bursting of steam bubbles. For this purpose, in particular the distance between the axial center of the pump and the chamber rear wall and the distance between the base and the pump suction bell are designed as a function of the suction-bell diameter and of the size of the chamber.

In order to avoid wall and base vortices and to achieve an acceptable speed profile in the pump tube, in preferred embodiments the pump chamber has as an alternative, and preferably in combination, the following features:

- a directing sill, running approximately perpendicularly to the inflow direction of the cooling water, on the chamber base in the region of the pump, said sill serving, in particular, for deflecting the flow in the direction of the pump;
- a longitudinal sill, arranged on the chamber base and running approximately in the direction of the inflow direction, as flow resistance for base vortices;
- a continuation of the longitudinal sill on the chamber rear wall as, in particular, a vertically running wall sill;
- a spacing of the wall sill from a chamber ceiling of the pump chamber, which is designed as a covered pump chamber, in order, for avoiding vortices, to ensure sufficient flow around the pump;
- the chamber side walls, as in the intake region, merge into the rear chamber walls via obliquely running wall regions.
- The chamber base is beveled in relation to the chamber rear wall.
- Longitudinal plates, running in particular perpendicularly to the chamber base, are arranged in the intake opening to the pump chamber.
- If required, the interior of the pump chamber is accessible from the outside via a flow-connection, which is used for further removal of cooling water or also for measuring coolant properties. Cooling-water removal is provided, for example, for extinguishing purposes or for temporary cleaning purposes by means of cooling water. To this end, pumps are usually arranged in the pump chamber or in the calming section. These act, however, as flow resistance and are often the cause of the formation of surface vortices. With the flow-connection via the chamber wall, there is no longer any need for the arrangement of such pumps in the interior.
- If use is made of so-called tubular type pumps, in which the pump tube is guided through a chamber ceiling of the pump chamber, it is possible, additionally or alternatively, for relatively large quantities of additional water to be withdrawn above the chamber ceiling. This water leaves the pump chamber through an annular gap between the pump tube and chamber ceiling.

In addition to the specific provisions made in the pump chamber itself, preferred developments also provide for vortex-avoiding and flow-calming and flow-evening measures, which contribute to evening out the flow, to be taken in the cleaning chamber. For this purpose, the cleaning chamber, like the pump chamber, has obliquely running side walls in the intake region to the pump chamber. Furthermore, a cleaning arrangement is arranged preferably immediately in front of the intake opening of the pump chamber and fully encloses the same. The cleaning arrangement preferably has a flow-directing plate on its side which is directed away from the pump chamber.

An alternative embodiment is preferably formed by designing the pump as a concrete spiral casing pump, the concrete spiral casing forming the chamber ceiling of the pump chamber. The concrete spiral casing pump here preferably has a suction tube which projects into the pump chamber.

In order to achieve the method-related object, an embodiment of the invention makes provision, in an operations building having a pump chamber and a pump for cooling water arranged therein, and having a cleaning chamber directly adjacent to the pump chamber, for the cooling water to be cleaned in the cleaning chamber and then to flow into the pump chamber at a flow speed of approximately 2 to 3 m/s, with the result that disruptive vortices are avoided.

The advantages given in respect of the operations building and preferred embodiments can be transferred analogously to the method.

BRIEF DESCRIPTION OF THE DRAWINGS

Exemplary embodiments of the invention are explained in more detail hereinbelow with reference to the drawings, in which, in schematic illustrations in each case.

DETAILED DESCRIPTION OF THE PREFERRED EMBODIMENTS

Figure 1:
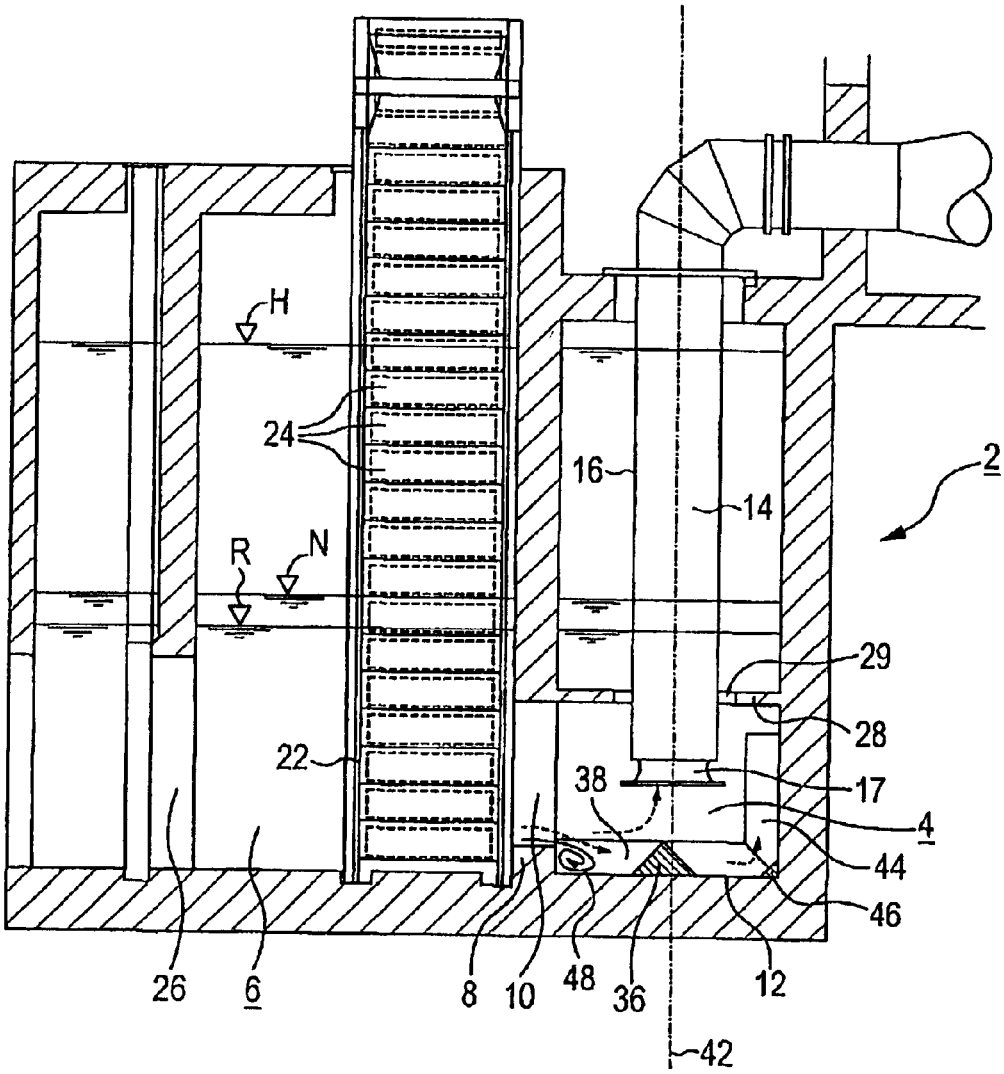
FIG. 1 shows, in detail form, a lateral illustration in section through an operations building, FIG. 2 likewise shows, in detail form, a lateral illustration in section through an operations building with a concrete spiral casing pump.
Figure 2:
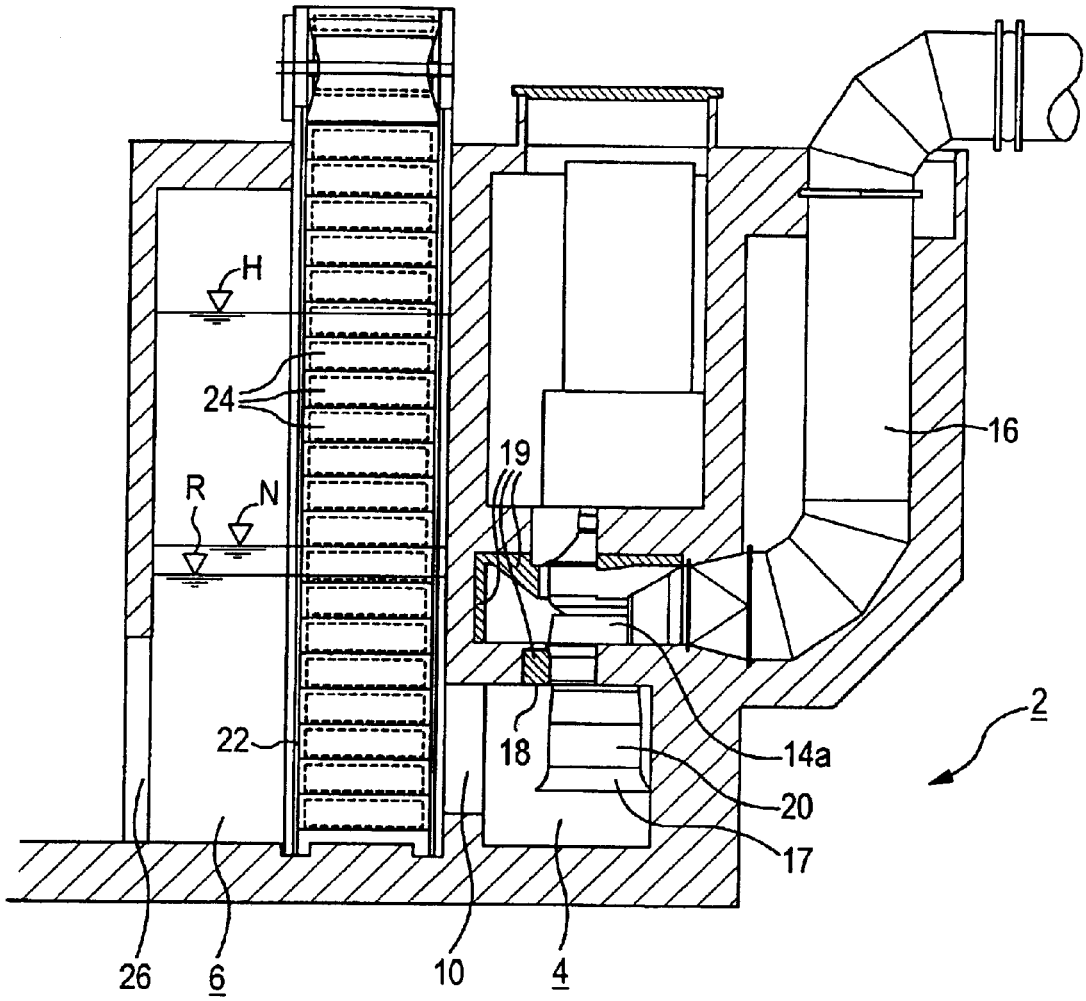

According to FIGS. 1 and 2, an operations building 2 for an, in particular, industrial plant, for example a power station for generating power, has a pump chamber 4 and a cleaning chamber 6, which are directly adjacent to one another via a common chamber wall 8. The cleaning chamber 6 and the pump chamber 4 are in flow-connection with one another via an intake opening 10. The pump chamber 4 is designed as a so-called covered pump chamber and has a chamber ceiling 28. Arranged in the pump chamber 4 is a pump 14 which is spaced apart from the chamber base 12 and has a pump tube 16. The latter is guided through the chamber ceiling 28, an annular gap 29 being formed in the process. In the pump chamber 4, a suction bell 17 adjoins the pump tube 16 on the end side.

Unlike the conventional separate pump 14 according to FIG. 1, the pump according to FIG. 2 is designed as a concrete spiral casing pump 14*a*. The latter has a concrete spiral casing which is formed by concrete components 19 positioned in the building structure or by the building structure itself. From the concrete spiral casing pump 14*a*, a suction tube 20, with suction bell 17 provided on the end side, extends into the pump chamber 4, with the result that the suction bell 17 is at a level which is favorable for operation.

Arranged in the cleaning chamber 6, immediately in front of the intake opening 10 and covering over the latter completely, is a cleaning arrangement for the cooling water in the form of a filter or of a screening arrangement 22. It is designed, in particular, as a so-called belt screen machine. The latter has a circulating belt screen with a plurality of screen surfaces 24, which serve for cleaning cooling water in the region of the intake opening 10 and are cleaned in the top region of the belt screen machine, for example, by jets. The screening arrangement 22 preferably has further cleaning arrangements (not illustrated specifically) arranged upstream of it.

The cooling water is usually removed from an natural reservoir, passes, via an inflow opening 26, into the cleaning chamber 6, is cleaned there and is then taken in through the intake opening 10 into the pump chamber 4 by the pump 14. The operations building 2 is arranged, in relation to the water level of the reservoir, such that, with a natural fluctuation of the water level between a high water level H and a low water level N, the suction bell 17, that is to say the inflow region of the pump 14, is sufficiently covered over with cooling water. This is because, if the covering-over level is too low, the quality of the flow in the pump tube 16 is impaired. This applies, in particular, when the water level drops below the chamber ceiling 28. This situation is thus admissible only for specific operating cases and for a limited period of time, for example during start-up of the pump 14, when the water is fed to the operations building 2 through a long channel or a long pipeline. A sufficiently high covering-over level, in addition, helps to avoid the so-called cavitation, that is to say the formation and abrupt bursting of steam bubbles to form a pressure wave which adversely affects the material. The illustrated design of the pump chamber 4 as a covered pump chamber with the chamber ceiling 28 counteracts the production of surface vortices.

Figure 3:
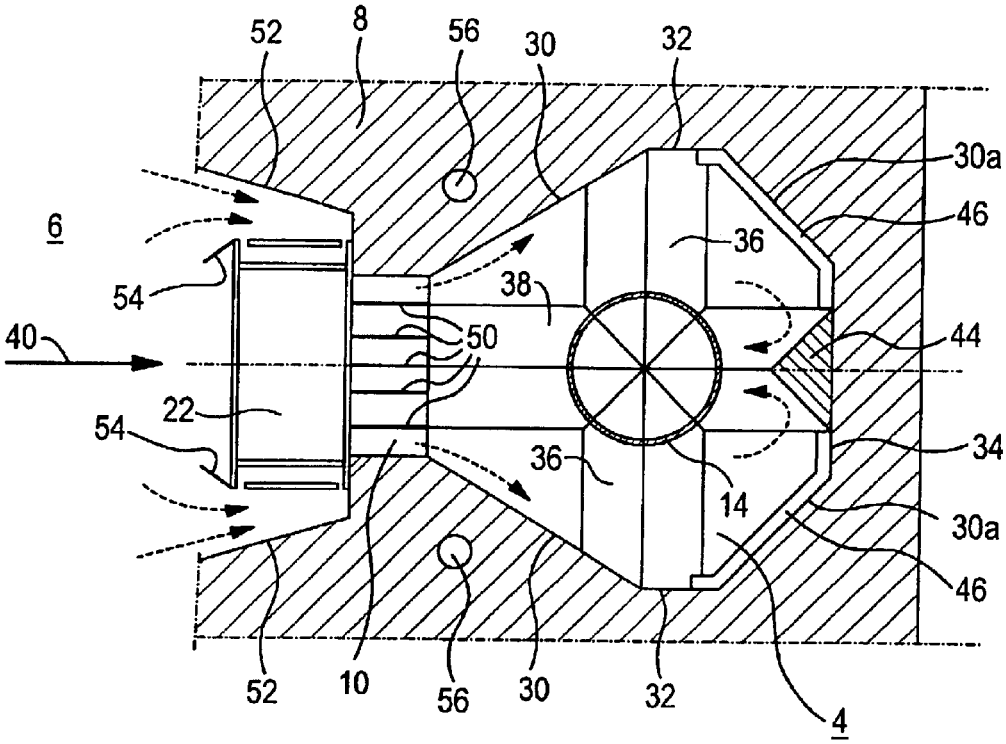
FIG. 3 shows a plan view of a horizontal section through a pump chamber.

The specific provisions made in order to avoid vortices are explained hereinbelow with reference to FIGS. 1 and 3. As can be gathered from FIG. 3, the wall region 30, which adjoins the intake opening 10, runs obliquely in relation to the chamber side wall 32 which, in turn, merges into the chamber rear wall 34 via a rear, oblique wall region 30*a*. Arranged on the chamber base 12 is a directing sill 36 and a longitudinal sill 38, which have a triangular cross-sectional surface and are arranged in relation to one another to form a cross. In this case, the longitudinal sill 38 runs in the inflow direction 40 of the cooling water.

The directing sill 36 serves primarily for deflecting the cooling liquid into the pump 14. For this purpose, as can be gathered from FIG. 1, it is preferably arranged some way in front of the pump axis 42. The directing sill 36 and the longitudinal sill 38 may have the same profile or different profiles and/or different dimensions. The longitudinal sill 38 serves for preventing base vortices. It is continued in a wall sill 44, which extends vertically upwards on the chamber rear wall 34 but is spaced apart from the chamber ceiling 28 in order to allow sufficient flow of cooling liquid around the pump 14. The wall sill 44 serves essentially for easier deflection of the flowing cooling liquid to the pump.

In the rear region of the pump chamber 4, the chamber base 12 is beveled in relation to the rear wall regions 30*a* and to the chamber rear wall 34 via a corner compensating means 46, which is illustrated by dashed lines in FIG. 1. This serves for improving the deflection of the base flow and reduces the degree of turbulence of the flow in this region. In general terms, the pump chamber 4 is distinguished in that, despite the use of planar boundary surfaces, it does not change the flow abruptly and this, despite the unusually high speed, achieves a low degree of turbulence in the pump tube 16. By virtue of the arrangement of bevels in the critical regions, the pump chamber 4 may thus be referred to as being largely edge-free. The typical flow paths of the cooling liquid are illustrated in the figures by dashed arrow lines. A comer compensating device in the base region of the intake opening 10 is dispensed with according to FIG. 1 since, there, a stable flow vortex 48 forms of its own accord, said flow vortex acting as a so-called "hydraulic ball bearing" in the manner of a stable roller, with the result that the rest of the flow flows over the flow vortex 48 in an essentially unaffected manner. The flow vortex 48 may be reduced, for example, by moderate beveling of the base region of the intake opening 10.

In particular the oblique front wall region 30 avoids separation of the flow from the chamber wall. This is achieved not least by the displacement action of the pump tube 14, which is decisively determined by the size and the position of the pump 14 in relation to the wall regions 30. In particular there is a reduction in the flow cross section for the cooling liquid following the intake opening 10, with the result that there is an increase in the flow speed. This prevents separation of the flow and thus already helps to avoid vortices. On account of the high speed of the flow, in addition, the situation where no in particular stationary flow vortices form on the surface is achieved in a straightforward and reliable manner. This is because such stationary flow vortices only form stably when there is sufficiently calm flow. Herein resides precisely the essential feature of the chamber geometry by way of which such comparatively calm flow is avoided. With the normal water level N, the chamber ceiling 28 results in an improvement in the speed distribution in the pump tube 16.

In order effectively to prevent disruptions from the screening arrangement 22 in the particularly critical region in the transition between the cleaning chamber 6 and pump chamber 4, in this case longitudinal plates 50, which are aligned essentially perpendicular to the chamber base 12, are provided. For a suitable flow guidance, in addition, the side walls 52 of the cleaning chamber 6 are beveled in relation to the intake opening 10. Furthermore, at its end which is directed away from the intake opening 10, the screening arrangement 22 has flow-directing plates 54 which are arranged on the borders on the front side of the screening arrangement 22 in a rectilinear manner or at an oblique angle in relation to said screening arrangement.

In the chamber wall 8, preferably in the region of the wall region 30, flow-connections 56 to the interior of the pump chamber 4 are provided. Cooling water may be removed from the pump chamber 4 via said connections without pumps which adversely affect the coolant flow having to be introduced into the interior of the pump chamber 4. Via the flow-connection 56, it is also possible to take measurements, such as a filling-level measurement, without the flow in the pump chamber 4 being affected. Alternatively or additionally, in the exemplary embodiment according to FIG. 1, that is to say with the use of a so-called tubular type pump, it is possible to remove a relatively large quantity of cooling water. In this case, the cooling water flows through the annular gap 29 between the chamber ceiling 28 and pump tube 16.

The formation both of base vortices and of surface vortices is reliably avoided by the measures described above. The decisive factor for this is the high speed in the pump chamber 4. In addition to the essential advantage of dispensing with the calming section, the pump chamber 4, in addition, can be operated reliably with the pump 14 being covered over by cooling water to a comparatively low extent. This is because the risk of surface vortices forming is considerably reduced in relation to conventional configurations. Even if the water level falls below the low water level N to a reduced water level R, which occurs under some circumstances, for example, during start-up and may drop below the level of the chamber ceiling 28, the cooling-water flow in the pump chamber 4 is sufficiently stable. The necessary covering-over level is thus determined essentially just by the cavitation problem. On account of the reduced covering-over level, the necessary overall height of the operations building 2 is reduced, with the result that the production costs can be kept low.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus, comprising:

a pump chamber for arranging a pump for cooling liquid, and a cleaning chamber, wherein the pump chamber is connected to the cleaning chamber via an intake opening, adjoined by a wall region which runs obliquely in relation to a side wall of the pump chamber, and wherein a flow cross section for cooling liquid flowing into the pump chamber is tapered in the pump chamber, resulting in the cooling liquid having a flow speed of approximately 2 to 3 m/s.

2. The apparatus as claimed in claim 1, wherein a chamber base of the pump chamber includes a directing sill, running approximately perpendicularly to the inflow direction of the cooling liquid, in a region of the pump for deflecting the flow in the direction of the pump.

3. The apparatus as claimed in claim 1, wherein a chamber base of the pump chamber includes a longitudinal sill, running approximately in the direction of the inflow direction of the cooling water, as flow resistance for base vortices.

4. The apparatus as claimed in claim 3, wherein the longitudinal sill is continued on a rear wall of the pump chamber as a wall sill.

5. The apparatus as claimed in claim 4, wherein the pump chamber is designed as a covered pump chamber with a chamber cover, and wherein the wall sill is spaced apart from the chamber cover.

6. The apparatus as claimed in claim 1, wherein the chamber side walls of the pump chamber merge into the chamber rear wall of the pump chamber via obliquely running rear wall regions.

7. The apparatus as claimed in claim 1, wherein a chamber base in a rear region of the pump chamber is beveled in relation to the chamber wall.

8. The apparatus as claimed in claim 1, wherein longitudinal plates are arranged in the intake opening.

9. The apparatus as claimed in claim 1, wherein an interior of the pump chamber is accessible via a flow-connection.

10. The apparatus as claimed in claim 1, wherein the pump chamber includes a chamber ceiling through which a pump tube is guided, an annular gap being formed in the process, with the result being that cooling water can be withdrawn from the pump chamber via the annular gap.

11. The apparatus as claimed in claim 1, wherein the cleaning chamber includes obliquely running side walls in the region oriented toward the pump chamber.

12. The apparatus as claimed in claim 1, wherein, in the cleaning chamber, a cleaning arrangement is arranged immediately in front of the intake opening.

13. The apparatus as claimed in claim 12, wherein a flow-directing plate is provided on the cleaning arrangement.

14. The apparatus as claimed in claim 1, wherein the pump is designed as a concrete spiral casing pump, the concrete spiral casing forming a chamber ceiling of the pump chamber.

15. An operations building for a plant comprising the apparatus as claimed in claim 1.

16. The operations building of claim 15, wherein the plant is a power-generation plant.

17. The apparatus as claimed in claim 1, wherein the cooling liquid flow speed is controlled in order to avoid disruptive vortices.

18. The apparatus as claimed in claim 17, wherein a chamber base of the pump chamber includes a directing sill, running approximately perpendicularly to the inflow direction of the cooling liquid, in a region of the pump for deflecting the flow in the direction of the pump.

19. The apparatus as claimed in claim 17, wherein a chamber base of the pump chamber includes a longitudinal sill, running approximately in the direction of the inflow direction of the cooling water, as flow resistance for base vortices.

20. The apparatus as claimed in claim 19, wherein the longitudinal sill is continued on a rear wall of the pump chamber as a wall sill.

21. The apparatus as claimed in claim 6, wherein the chamber base in a rear region of the pump chamber is beveled in relation to the chamber wall.

22. The apparatus as claimed in claim 19, wherein, in the cleaning chamber, a cleaning arrangement is arranged immediately in front of an intake opening to the pump chamber.

23. The apparatus as claimed in claim 22, wherein a flow-directing plate is provided on the cleaning arrangement.

* * * * *